US005184110A

United States Patent [19]

Horng

[11] Patent Number: 5,184,110

[45] Date of Patent: Feb. 2, 1993

[54] HANDLE-ATTACHABLE SUITCASE ALARM

[76] Inventor: Ming-Gin Horng, 6F-1, No. 86, Keh Nan St., Taipei, Taiwan

[21] Appl. No.: 772,542

[22] Filed: Oct. 7, 1991

[51] Int. Cl.[5] ..... G08B 13/14; H01H 9/06

[52] U.S. Cl. ..... 340/571; 200/61.85

[58] Field of Search ..... 340/571, 568, 539, 665; 190/101; 200/61.85, 293.1, 332.2, 505

[56] References Cited

U.S. PATENT DOCUMENTS 3,656,144 4/1972 Forte ..... 340/571 X 4,728,937 3/1988 Hsu ..... 340/571

4,908,606 3/1990 Kevonian ..... 340/571

5,001,460 3/1991 Basson ..... 340/571

*Primary Examiner*—Jin F. Ng

*Assistant Examiner*—Thomas J. Mullen, Jr.

*Attorney, Agent, or Firm*—Bacon & Thomas

[57] ABSTRACT

An alarm for attachment to the handle of a suitcase and including a cover provided with contact faces and a conduction strip which activates a battery operated alarm when an unauthorized individual grips the cover to complete an electrical circuit.

4 Claims, 3 Drawing Sheets

HANDLE-ATTACHABLE SUITCASE ALARM

BACKGROUND OF THE INVENTION

The present invention relates to an alarm, and particularly to an alarm attachable to the handle of a suitcase.

Most conventional suitcases or briefcases are made without any alarm means and are therefore easily stolen when they are positioned somewhere away from the owners. As a result, there have been alarms developed specially for suitcases and the like.

Presently, commercially available suitcase alarms are designed for attachment to the suitcase during manufacturing and therefore cannot be easily removed for use on another suitcase. There is also a vibration-triggered suitcase alarm locked by secret codes, but this is not suitable for use during the riding of buses or cars because vibration from a vehicle can easily trigger the alarm, in addition, the secret codes have to be set after the alarm is taken out of the suitcase. It is inconvenient and time consuming to use such suitcase alarms.

It is therefore the purpose of applicant to develop a suitcase alarm which eliminates the above disadvantages in conventional suitcase alarms.

SUMMARY OF THE INVENTION the present invention provides a soft handle cover for enclosing the handle of a suitcase. The outer surface of the soft handle cover is divided into two control areas, namely, A-electrode and B-electrode contact faces. An extending conduction strip connects these two contact faces and control an alarm means. Whenever the A-electrode and the B-electrode contact faces are touched by anyone who carries the suitcase, they complete a circuit through the human body as a conductor, and a signal is generated and transmitted to the alarm means through the conduction strip.

BRIEF DESCRIPTION OF THE DRAWINGS

These and other objects and features of the present invention will become more apparent from the following description taken in connection with the accompanying drawings wherein.

DETAILED DESCRIPTION OF THE PREFERRED EMBODIMENTS

Figure 1:
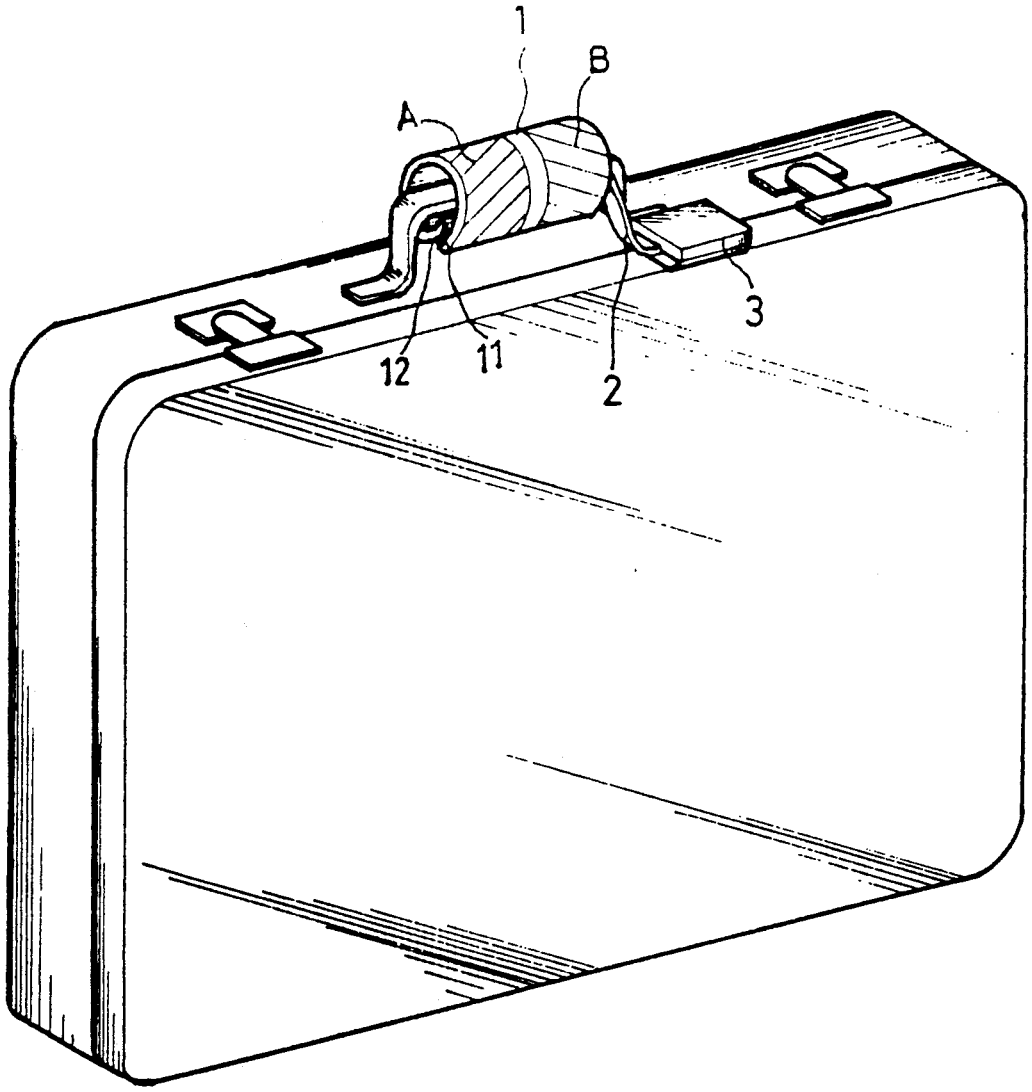
FIG. 1 is a perspective view showing the present invention attached to a suitcase.

Please refer to FIG. 1. A soft handle cover 1 is used to enclose around a suitcase handle and two ends of the handle cover connect with each other with two pieces of Velcro, a form of hook and loop fastener, 11, 12 fixed thereon. The outer surface of the handle cover is divided into two areas, namely, A-electrode and B-electrode contact faces; and a conduction strip 2 extends from the handle cover 1 to connect an alarm means 3. In the event someone wants to steal the suitcase and grips the handle with the soft handle cover provided by the present invention, the hand will contact the A- and B-electrode contact faces. Since the human body is a high impedance conductor, the connection of the A- and B-electrode contact faces through the hand will cause the A- and B-electrodes to make and generate a signal which is transmitted through the conduction strip 2 to the alarm means 3 so that the latter emits an alarm.

Figure 2:
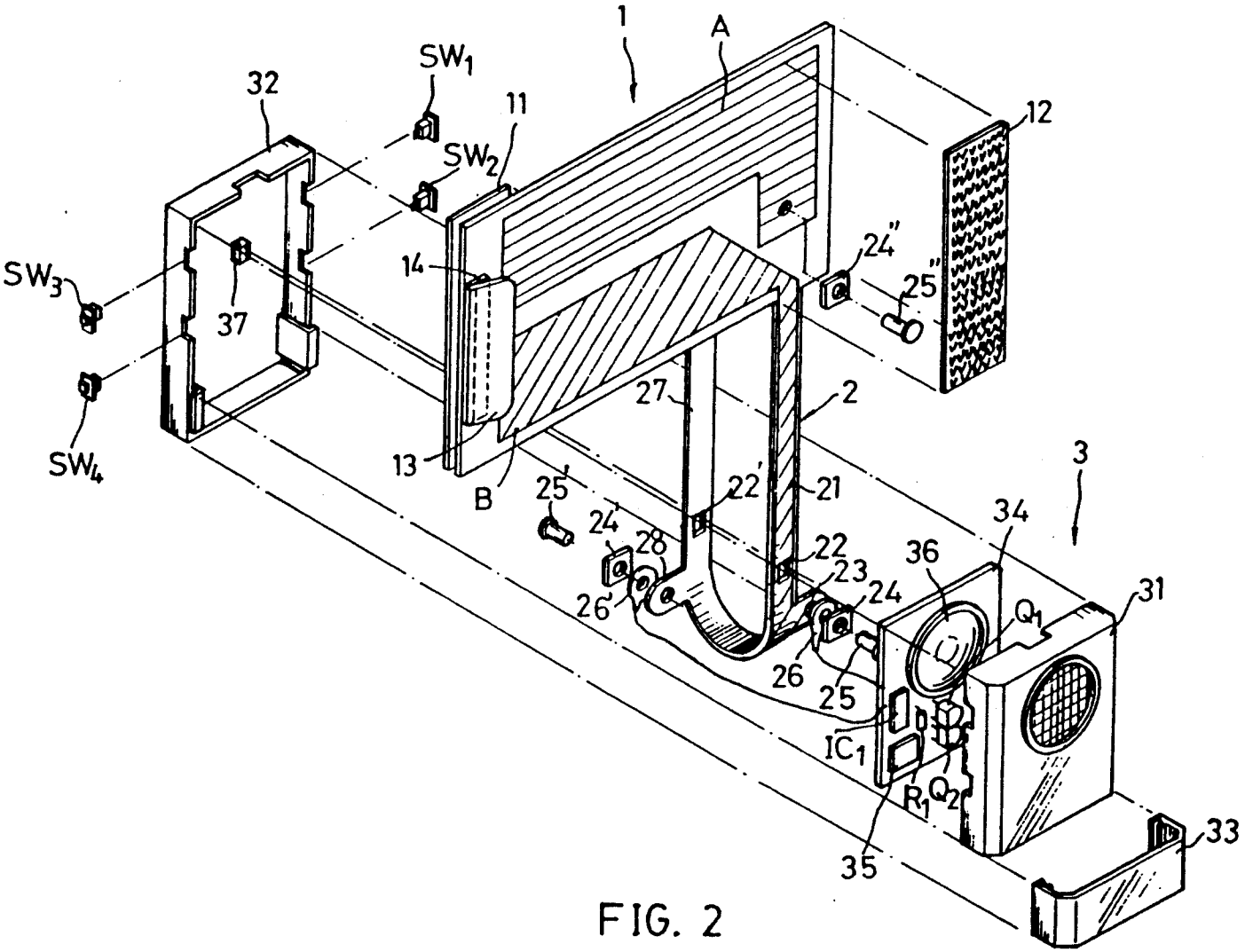
FIG. 2 is an exploded perspective view showing the components and structure of the present invention.

Please refer to FIG. 2. The soft handle cover 1 is made of genuine leather or PVC leather. Such material tends to absorb moisture and is, therefore, easily affected by ambient humidity or dryness. Under such circumstances, the material always gives unsteady insulation. To prevent this condition, the material needs to first undergo an insulation treatment test, and then be coated with a layer of insulation ink under predetermined criteria so that it may maintain steady insulation impedance under any environment. The treated leather is then cut into rectangular pieces, each of which is printed with conductive ink to form an A-electrode control face and a B-electrode control face. With two pieces of Velcro 11, 12 sewn to respective ends of the handle cover 1, the handle cover 1 may then be rolled around the suitcase handle with the two ends tightly joined to each other while the A- and B-electrode contact faces are exposed to air.

In the event the present invention is to be used in an extremely dry area where normal insulation conditions might be changed, a conductive member 13 may be connected to one end of the soft handle cover 1 at a position just across the A-and B-electrode contact faces. An insulation pad 14 is used to keep the conductive member 13 from touching the two A-and B-electrode contact faces. However, when the suitcase handle is gripped, the conductive member 13 is simultaneously depressed to touch and therefore contact the A- and B-electrode contact faces.

The conduction strip 2 extends from the right side of the handle cover 1 and is divided from its center into two parts, namely, an A-conduction section 21 and a B-conduction section 27. The conduction strip 2 is looped around its middle portion so that its far end connects to the A-electrode contact face and is fixed thereto by a rivet 25" and a conductive rubber washer 24", permitting it to maintain good conductivity. The root end of the conduction strip 2 connects with the B-electrode contact face. The A- and B-conduction sections each has a semicircular connection ear 23, 28 near and above the middle portion of the conduction strip 2 to project rightward and leftward, respectively. Both the connection ears 23, 28 have centered through holes formed therein. Meanwhile, square through holes 22, 22' are formed on the conduction strip 2 at a position somewhat above the connection ears 23, 28.

The alarm means 3 mainly consists of a housing, an alarm circuit, and conductor terminals. The housing includes a top cover 31 having a speaker screen formed thereon, a battery cover 33, and a seat 32 having a square cotter 37 provided therein and a plurality of switch openings provided at its two sidewalls. The alarm circuit consists of an alarm IC1, transistors Q1, Q2, a resistor RI, a power switch SW1, a battery 35, a loudspeaker 36, and a base board 34 on which the alarm IC1, transistors Q1, Q2, resistor RI, battery 35, loudspeaker 36, etc. are mounted according to designed circuit arrangement. The assembled base board 34 is positioned in the seat 32 and then connected with the connection ears 23, 28 of the conduction strip 2 with the conductor terminals 26, 26', respectively, before it is fixed thereto with conductive rubber washers 24, 24' and rivets 25, 25'. Power switch SWI is mounted in one of the switch openings formed on the sidewalls of the seat 32 so that it may connect the base board 34.

When assembling the alarm means 3, the square cotter 37 inside the seat 32 extends into the two square through holes 22, 22' formed on the conduction strip 2, the speaker screen on the top cover 31 matches with the loudspeaker 36, and the battery 33 matches with the battery cover 35. A plurality of disguised switches SW2, SW3, and SW4 may be installed at the switch openings formed on two sides of the seat 32 with their contact points connected to the A- and B-electrode contact faces. When the switches are turned on, an alarm will be emitted even though the real power switch SWI is turned OFF.

Figure 3:
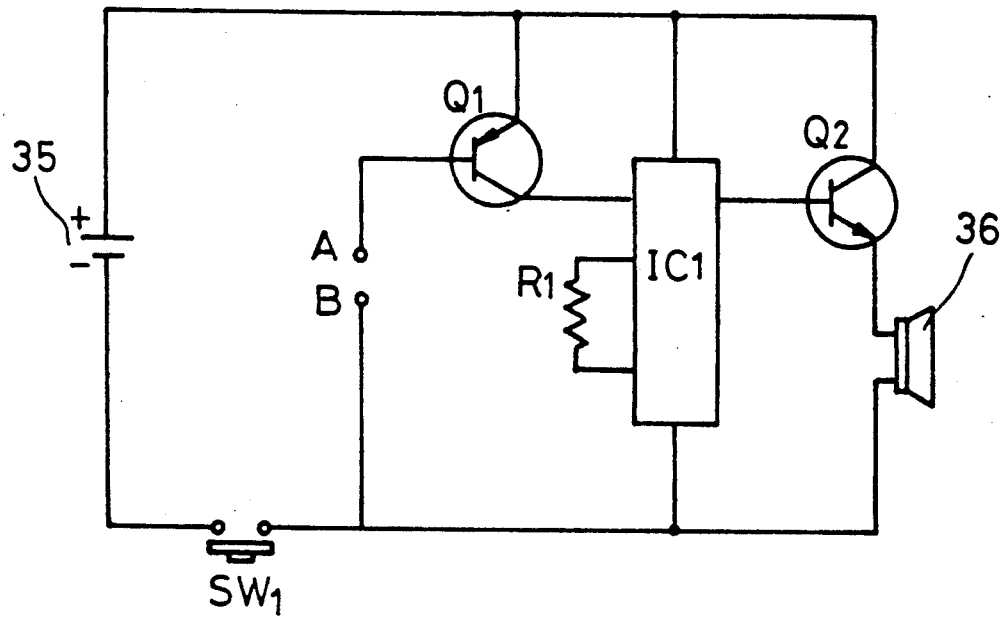
FIG. 3 is a block diagram of the circuit of the present invention.

Please refer to FIG. 3 in which a block diagram of the circuit of the present invention is shown. In the diagram, points A and B represent the A-and B-electrode contact faces, respectively. When the power switch SWI is turned ON, power from the battery 35 shall keep the circuit in an alarm state. When the A- and B-electrode contact faces are made to contact by an unauthorized gripping of the handle cover 1, base of the transistor Q1 shall operate upon receiving a negative deflecting voltage, and generates a signal which is passed to the alarm IC1 to emit an alarm which is amplified by the transistor Q2 and thereby activates the loudspeaker 36, thus sounding the alarm and notifying the owner of the suitcase.

Many changes and modifications in the above described embodiment of the present invention can, of course, be carried out without departing from the scope thereof. Accordingly, to promote the progress in science and the useful arts, the present invention is disclosed and is intended to be limited only by scope of the appended claims.

What is claimed is:

1. An alarm for attachment to the handle of a suitcase comprising:

a) a soft cover of steady insulation impedance for attachment to a handle of suitcase, the cover including plural contact faces and means for detachably securing the cover around the handle;

b) a conduction strip including two conduction sections, two ends attached to the cover, plural connection ears, each connection ear provided with a first through hole formed therein, and plural second through holes formed in the conduction strip;

c) a housing including a top cover, a loudspeaker screen, a battery cover, a seat having a square cotter, a plurality of switch openings and a base board mounted on the seat;

d) an alarm means including an alarm circuit having an alarm IC, two transistors, a resistor, a power switch, a battery and a loudspeaker; and e) conductor terminals for connecting the alarm circuit to the connection ears, wherein bridging of the contact faces by an unauthorized human hand gripping the handle of a suitcase to which the cover is attached completes the circuit and triggers the alarm means.

2. The alarm of claim 1 wherein the soft handle cover further includes a conductive member connected at one end across the plural contact faces, and an insulation pad below the conductive member for preventing the conductive member from touching the contact faces until the handle is gripped by the human hand.

3. The alarm of claim 1 wherein the alarm means further includes a plurality of disguised switches installed in the switch openings with their contact points connected with the contact faces in order to permit activation of the alarm when the power switch is turned off.

4. The alarm of claim 1 wherein the means for detachably securing the soft cover to the handle includes a Velcro attachment means, the connection ears are each of a semicircular configuration, the soft handle cover is formed of leather and each of the second through holes is of a square configuraion.

* * * * *